US011555318B2

(12) United States Patent
Lennox

(10) Patent No.: US 11,555,318 B2
(45) **Date of Patent: *Jan. 17, 2023**

(54) ROOF COVER SYSTEM IMPROVEMENT

(71) Applicant: SYSTEM STORMSEAL PTY LTD, Rockdale (AU)

(72) Inventor: Matthew Lennox, Rockdale (AU)

(73) Assignee: SYSTEM STORMSEAL PTY LTD, Rockdale (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/231,755

(22) Filed: Apr. 15, 2021

(65) Prior Publication Data

US 2021/0230890 A1 Jul. 29, 2021

Related U.S. Application Data

(63) Continuation-in-part of application No. 15/783,813, filed on Oct. 13, 2017, now Pat. No. 11,168,484,
(Continued)

(30) Foreign Application Priority Data

Jun. 2, 2008 (AU) ..... 2008202416
Jul. 30, 2008 (AU) ..... 2008203409
(Continued)

(51) Int. Cl.
*E04G 21/28* (2006.01)
*E04D 12/00* (2006.01)
(Continued)

(52) U.S. Cl.
CPC ..... *E04G 21/28* (2013.01); *E04D 12/002* (2013.01); *E04D 5/00* (2013.01); *E04D 5/06* (2013.01); *E04G 2021/248* (2013.01)

(58) Field of Classification Search
CPC ..... B29C 66/1122; E04D 5/06; E04G 21/28; E04G 2021/248
See application file for complete search history.

(56) References Cited

U.S. PATENT DOCUMENTS 4,061,519 A 12/1977 Hammer
4,769,962 A 9/1988 Pohl et al.
(Continued)

FOREIGN PATENT DOCUMENTS

AU 199466002 A 6/1994
AU 2008202416 B1 9/2008
(Continued)

OTHER PUBLICATIONS

International Search Report of the International Searching Authority, completed Jul. 20, 2009, by the Australian Patent Office for International Application PCTAU2009/000685, 5 pages.
(Continued)

*Primary Examiner* — Carson Gross
(74) *Attorney, Agent, or Firm* — Hayes Soloway PC

(57) ABSTRACT

A roof cover of a building under construction includes a heat shrinkable film stretched over the roof framing of said building under construction. The film brought into conformity with said roof framing through application of heat. The film may be formed by a number of adjoining sheets or strips of material.

3 Claims, 12 Drawing Sheets

Related U.S. Application Data which is a continuation of application No. 12/995,966, filed as application No. PCT/AU2009/000685 on Jun. 2, 2009, now Pat. No. 9,822,536.

(30) Foreign Application Priority Data

| | | |
|---|---|---|
| Oct. 30, 2008 | (AU) | 2008101060 |
| Jan. 22, 2009 | (AU) | 2009200232 |
| Apr. 15, 2020 | (AU) | 2020202535 |

(51) Int. Cl.

| | |
|---|---|
| ***E04D 5/06*** | (2006.01) |
| ***E04D 5/00*** | (2006.01) |
| ***E04G 21/24*** | (2006.01) |

(56) References Cited

U.S. PATENT DOCUMENTS

| | | | | |
|---|---|---|---|---|
| 4,818,588 | A | 4/1989 | Okabe et al. | |
| 5,935,357 | A * | 8/1999 | Hubbard | B29C 66/86533 156/82 |
| 6,206,991 | B1 | 3/2001 | Starr | |
| 6,425,213 | B1 | 7/2002 | Lachapelle | |
| 6,632,496 | B1 | 10/2003 | Johnson et al. | |
| 6,797,218 | B1 | 9/2004 | Bickerstaff | |
| 7,517,941 | B2 | 4/2009 | Myhre et al. | |
| 9,822,536 | B2 | 11/2017 | Lennox et al. | |
| 2002/0095898 | A1 | 7/2002 | Bettencourt | |
| 2005/0217202 | A1 | 10/2005 | Crook | |
| 2008/0022620 | A1 | 1/2008 | Crowley | |
| 2008/0060302 | A1 | 3/2008 | Bletsos et al. | |
| 2018/0100317 | A1 | 4/2018 | Lennox et al. | |

FOREIGN PATENT DOCUMENTS

| | | | |
|---|---|---|---|
| EP | 0410275 | A1 | 1/1991 |
| EP | 2376206 | A | 11/2002 |
| GB | 2388815 | A | 11/2003 |
| WO | 2009146487 | A1 | 12/2009 |

OTHER PUBLICATIONS

Written Opinion of the International Searching Authority, completed Oct. 8, 2010 by the Australian Patent Office for International Application PCT/AU2010/001026, 6 pages.

International Search Report of the International Searching Authority, completed Oct. 8, 2010 by the Australian Patent Office for International Application PCT/AU2010/001026, 4 pages.

* cited by examiner

ROOF COVER SYSTEM IMPROVEMENT

CROSS-REFERENCE TO RELATED APPLICATIONS AND PRIORITY

This patent application is a Continuation-in-Part Application of U.S. patent application Ser. No. 15/783,813 filed Oct. 13, 2017, which is a Continuation of U.S. patent application Ser. No. 12/995,966 filed May 31, 2011, which claims priority from PCT Patent Application No. PCT/AU2009/000685 filed Jun. 2, 2009, which claims priority from Australian Patent Application No. 2009200232 filed Jan. 22, 2009, Australian Patent Application No. 2008101060 filed Oct. 30, 2008, Australian Patent Application No. 2008203409 filed Jul. 30, 2008, and Australian Patent Application No. 2008202416 filed Jun. 2, 2008 and additionally claims priority from Australian Patent Application No. 2020202535 filed Apr. 15, 2020. Each of these patent applications are herein incorporated by reference in their entirety.

The present invention relates to protective covering of roofs and, more particularly, to the covering of damaged or under construction roofs.

BACKGROUND

Roofs are susceptible to damage from high winds, rain or hail. Tiled roofs for example may have a considerable area of tiles either damaged from hail impact, or dislodged completely as the result of high intensity storms. Shingled roofs are liable to be similarly damaged, and even metal sheeted roofs may suffer partial or total removal of one or more sheets. Damage to roofs may also be caused by the impact of falling trees or large branches.

Storm or impact damage cannot usually be immediately repaired so that to prevent further or potential damage to the interior of the building, temporary covering must be provided. Typically canvas (or similar material) tarpaulins are placed over the damaged part of the roof and secured to the structure by ropes.

One disadvantage of this method of temporary covering is the difficulty of adequately securing a tarpaulin to the roof so that they remain very vulnerable to dislodgement should high winds prevail or recur and often require continuing attention and adjustment. Moreover, they are heavy and awkward to position, posing occupational health and safety issues. A further disadvantage is that they are expensive to acquire and bulky to store, and if the may many roofs are damaged in one storm event, the number of tarpaulins available may be inadequate.

Buildings under construction, particularly timber framed, brick clad dwellings, are frequently constructed in a sequence where the timber frame, including that of the roof, is completed a considerable time before the roof cladding can be added. A disadvantage of this construction technique is that during this period the timber of the structure, which may even include timber or particle board flooring, is liable to deterioration from water and sun. A further disadvantage of this sequence of construction is that, if rain intervenes at the time further internal work is scheduled, the lack of roof covering may cause considerable delay and financial loss.

It is an object of the present invention to address or at least ameliorate some of the above disadvantages.

Notes

The term "comprising" (and grammatical variations thereof) is used in this specification in the inclusive sense of "having" or "including", and not in the exclusive sense of "consisting only of".

The above discussion of the prior art in the Background of the invention, is not an admission that any information discussed therein is citable prior art or part of the common general knowledge of persons skilled in the art in any country.

BRIEF DESCRIPTION OF INVENTION

According to one broad form of the invention, there is provided a roof cover of a building under construction; said cover comprising a heat shrinkable film stretched over the roof framing of said building under construction; said film brought into conformity with said roof framing through application of heat.

Preferably, the heat shrinkable film provides a temporary or permanent waterproofing of said building under construction.

Preferably, the heat shrinkable film is provided with a heat reflecting surface.

Preferably, the heat shrinkable film forms a permanent layer; said layer excluding inclement weather from said building under construction.

Preferably, the heat shrinkable film is retained by mechanical means at edges of damaged or uncompleted roof framing.

Preferably, the mechanical means include a temporary batten affixed under eaves o said roof framing.

Preferably, the heat shrinkable film has a thickness of between 0.6 and 0.7 mm.

Preferably, the heat shrinkable film is a film of low-density polyethylene.

Preferably, the heat shrinkable film includes shrinking resins, UV inhibitors, anti-brittling compounds and strengthener.

Preferably, the heat shrinkable film is retained as a permanent heat reflecting layer under subsequently applied permanent roof cladding.

According to another broad form of the invention, there is provided a method of covering a roof of a building with a film of material; the film comprising an assembly of sheets of polymer film stretched over at least a portion of the roof; the method including the steps of:

- Positioning a first and a second sheet of the polymer film side by side on a supporting surface,
- Applying spaced-apart strips of double-sided adhesive tape to a surface of a first sheet of the pair of sheets,
- Turning over the first of the pair of sheets to place it over the second sheet such that the spaced-apart strips of adhesive define an overlap of the first and second sheets,
- Repeating this process to add further sheets as required to cover a desired area of the roof.

Preferably, a portion of a trailing or leading end of the film is wrapped around a film securing batten sufficient to secure the film to the batten.

Preferably, the film securing batten is secured to a surface of the roof by suitable fasteners.

Preferably, application of the covering to an area of tiled roof includes the step of removing selected tiles to install supporting brackets to underlying roof framing.

Preferably, the film securing batten is attached to the supporting brackets.

Preferably, a film securing batten at a leading end of a first film of polymer material is secured together with a film securing batten at a trailing end of a second film of polymer material; the film securing battens place one on top of the other to allow fasteners to secure the battens to the underlying roof framing or to the roof cladding.

According to another broad form of the invention, there is provided a method of applying a waterproof film of polymer material to a surface of a roof; the method including the steps of:

Determining location of perimeter edges of a first sheet of polymer material on the surface of the roof, Applying strips of adhesive along the perimeter edges, Aligning the first sheet of polymer material with the strips of adhesive and applying the sheet to the adhesive, Determining perimeter edges of a second adjoining sheet of polymer material and applying strips of adhesive along the perimeter edges of the second adjoining sheet to the roof surface so as to provide an overlap with the first sheet, Aligning the second adjoining sheet with the strips of adhesive an applying the sheet to the adhesive, Heat welding the second sheet to the first sheet along the overlap, Repeating the above steps to cover a required area of the roof surface with a number of sheets.

Preferably, the polymer material is a heat shrinkable material.

Preferably, in a further step of the method, heat is applied to the sheets to shrink and conform the sheets to the roof surface.

Preferably, edges of sheets along edges of the roof surface may be affixed to the edges of the roof by mechanical means.

Accordingly, in another broad form of the invention, there is provided a roof cover of a building under construction; said cover comprising a heat shrinkable film stretched over the roof framing of said building under construction; said film brought into conformity with said roof framing through application of heat.

Preferably, said heat shrinkable film provides a temporary or permanent waterproofing of said building under construction.

Preferably, said heat shrinkable film is provided with a heat reflecting surface.

Preferably, said heat shrinkable film forms a permanent layer; said layer excluding inclement weather from said building under construction.

Preferably, said heat shrinkable film is retained by mechanical means at edges of damaged or uncompleted roof framing.

Preferably, said mechanical means include a temporary batten affixed under eaves of said roof framing.

Preferably, said heat shrinkable film has a thickness of between 0.6 and 0.7 mm.

Preferably, said heat shrinkable film is a film of low-density polyethylene.

Preferably, said heat shrinkable film includes shrinking resins, UV inhibitors, anti-brittling compounds and strengthener.

Preferably, said heat shrinkable film is retained as a permanent heat reflecting layer under subsequently applied permanent roof cladding.

In another broad form of the invention, there is provided a method of covering a roof of a building with a film of material; the film comprising an assembly of sheets of polymer film stretched over at least a portion of the roof; the method including the steps of:

Positioning a first and a second sheet of the polymer film side by side on a supporting surface, Applying spaced-apart strips of double-sided adhesive tape to a surface of a first sheet of the pair of sheets, Turning over the first of the pair of sheets to place it over the second sheet such that the spaced-apart strips of adhesive define an overlap of the first and second sheets, Repeating this process to add further sheets as required to cover a desired area of the roof.

Preferably, a portion of a trailing or leading end of the film is wrapped around a film securing batten sufficient to secure the film to the batten.

Preferably, the film securing batten is secured to a surface of the roof by suitable fasteners.

Preferably, application of the covering to an area of tiled roof includes the step of removing selected tiles to install supporting brackets to underlying roof framing.

Preferably, the film securing batten is attached to the supporting brackets.

Preferably, a film securing batten at a leading end of a first film of polymer material is secured together with a film securing batten at a trailing end of a second film of polymer material; the film securing battens place one on top of the other to allow fasteners to secure the battens to the underlying roof framing or to the roof cladding.

BRIEF DESCRIPTION OF DRAWINGS

Embodiments of the present invention will now be described with reference to the accompanying drawings wherein.

DETAILED DESCRIPTION OF PREFERRED EMBODIMENTS

The roof cover system of the present invention provides for a system and method for covering a damaged or uncompleted roof of a building. The system uses a heat shrinkable film, preferably a low-density polyethylene containing shrinking resins, UV inhibitors, anti brittling compounds and strengtheners for tear resistance. The film is preferably between 150 and 300 microns in thickness and is provided in rolls of various widths and lengths. In at least one preferred form of the film, it is provided with a heat reflective surface.

First Preferred Embodiment

Figure 1:
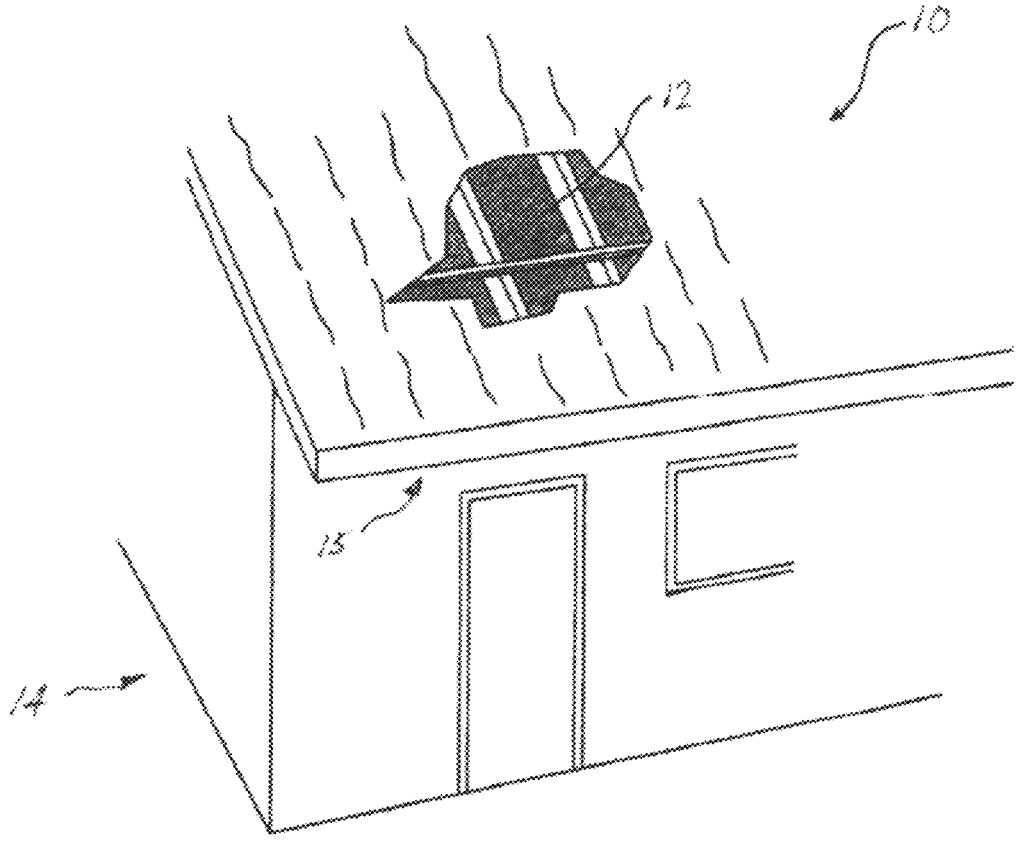
FIG. 1 is a perspective view of a portion of a building of which the roof has sustained damage.

With reference now to FIG. 1, typical damage to a tiled roof 10 of a building 12 may include the loss of a number of tiles 12 due to a high wind shear event, leaving the building 14 open to the ingress of water. Water ingress may also occur if tiles are cracked for example from heavy hail impact or falling trees or branches. Emergency temporary repair is provided by the roof cover system of the invention by applying the above described film over that portion of the roof which has sustained damage.

If required, sharp edges protruding from the roof surface may first be covered with suitable wadding and adhesive tape to prevent possible tearing of the film during application.

Figure 2:
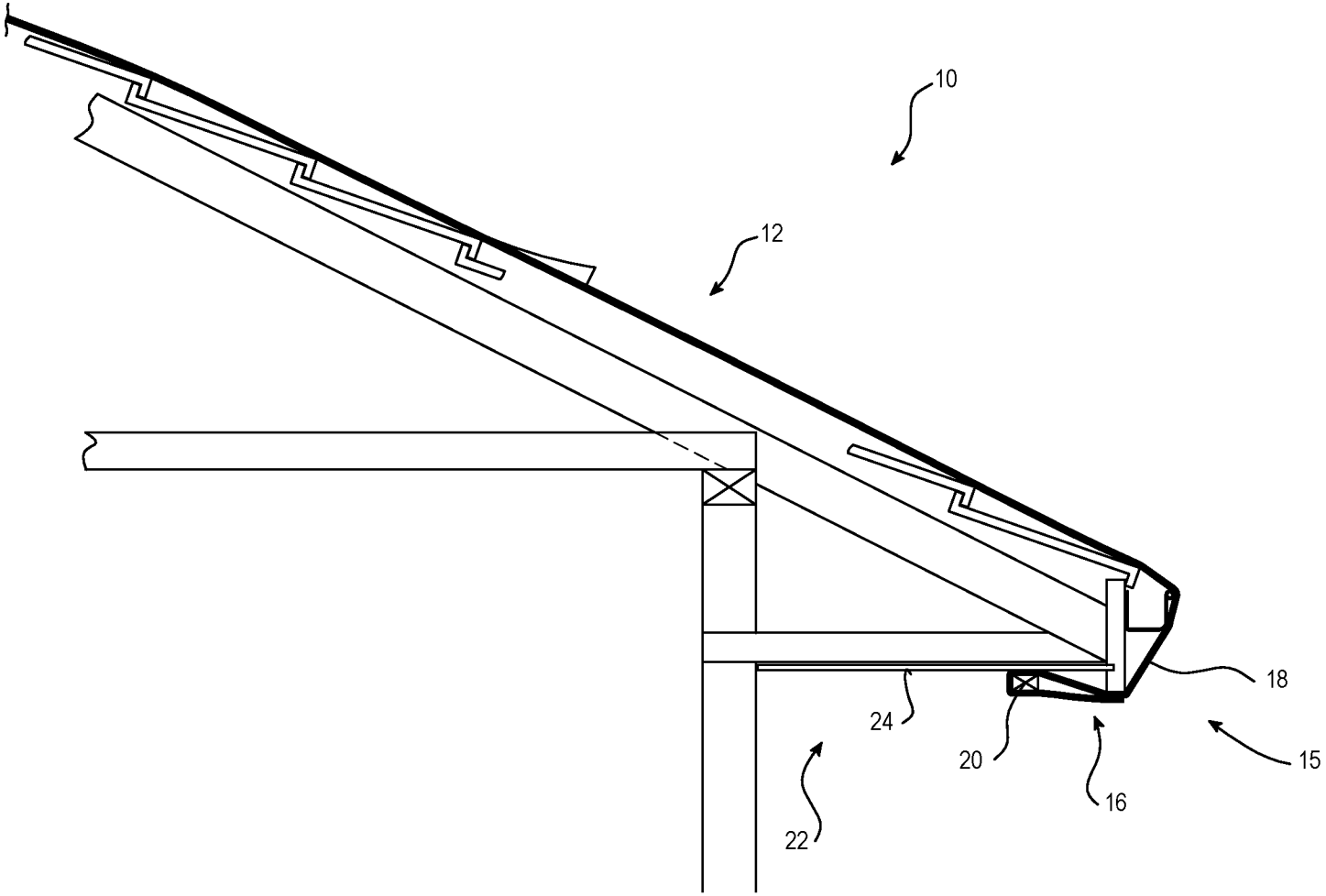
FIG. 2 is a side sectioned view of a portion of a building and existing roof structure to which has been applied a roof cover system according to the invention.

The extent of roof to be covered is measured and the most suitable available width roll of the heat shrinkable film selected. Film is cut to one or more lengths sufficient to extend from one edge of the roof to an opposite edge. With reference to FIG. 2, a trailing edge of a length of film is mechanically attached at the first edge 16 of the roof 10. In one preferred method as shown in FIG. 2, the trailing edge 15 of the film 18 is wrapped once around a length of batten 20, preferably as long as the width of the film, and the batten 20 nailed to the underside 22 of the eaves 24 at the first edge of the roof 10.

The leading edge is now passed over the roof to the opposite edge (not shown) of the roof and the leading edge secured to the opposite side eaves in similar manner to that already described. If the outer side edge of the length of film adjoins an edge of the roof, this may be similarly secured under the eaves along that side of the roof. Alternatively, the leading edge may be secured to the barge or fascia boards.

Heat is now applied to the film at the underside of the eaves 24 with a heat gun (not shown) to cause the film 18 to shrink securely around the batten and the undersides of the eaves. The heat gun, now attached to an extension arm (not shown), is then used to apply heat to the entire length of film 18 stretched over the roof surface, causing it to tightly conform to the surface and covering missing or cracked tiles 12.

If the extent of the damage requires, successive lengths of film can be applied side by side with an overlap of preferably 150 mm. Heat is applied along these overlaps to seal the edges of the adjoining lengths together.

Valley areas and other discontinuities in the roof surface can be accommodated by cutting film to suit the are involve and heat sealing to adjoining film length edges. Vertical roof penetrations, such as chimney stacks ventilators and the like, are sealed by preferably a 300 mm rise of film. Edges of riser sections of film can be taped or cable-tied to the penetration.

By the above means, a damaged roof can be rapidly and securely covered to prevent water ingress and damage to the inside of the building. Unlike tarpaulins which are difficult to secure an remain liable to dislodgement in high winds, the heat shrinkable film by conforming closely to the roof surface, provides a secure seal over the damage until permanent repairs can be made.

Second Preferred Embodiment

Figure 3:
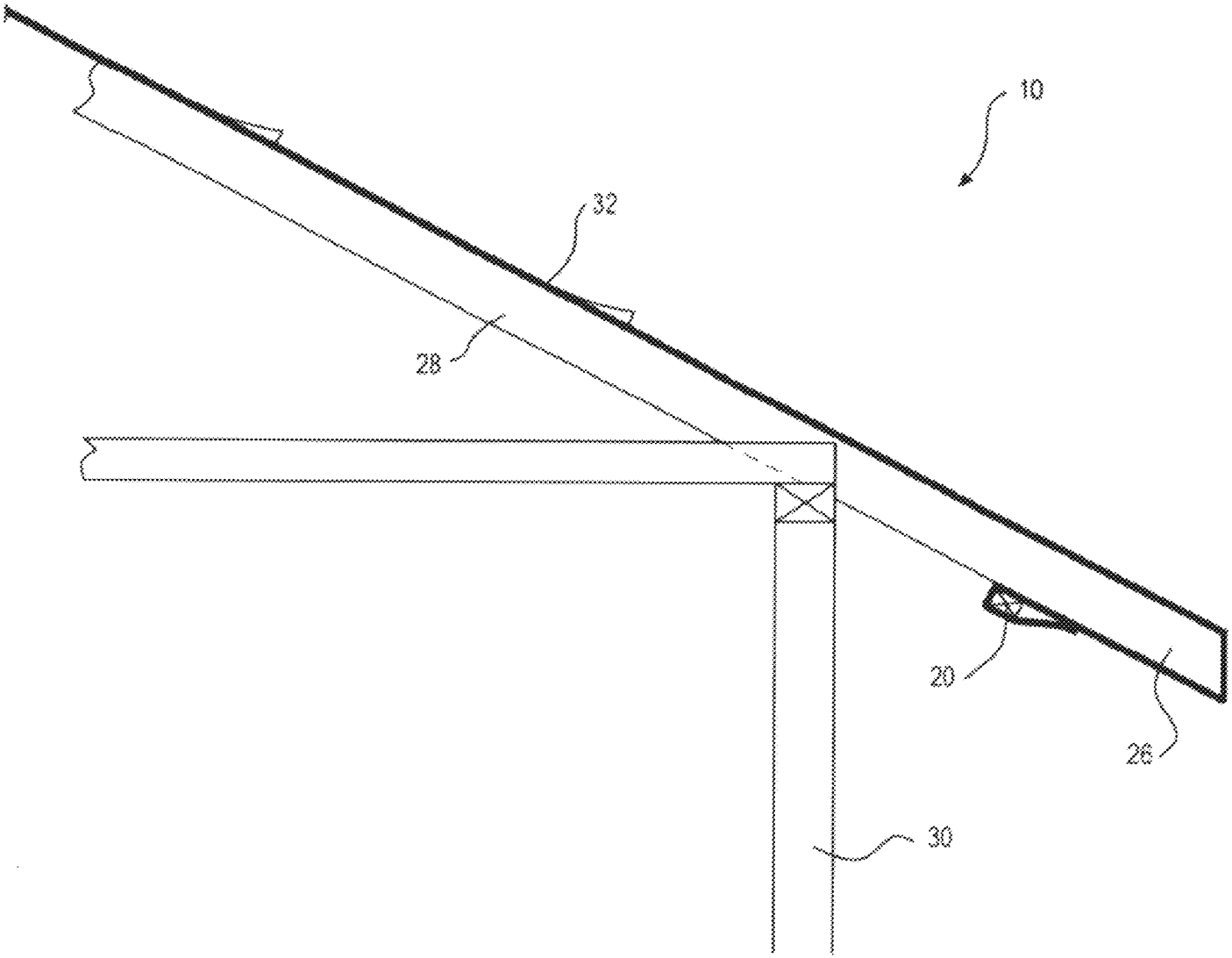
FIG. 3 is a side sectioned view of a portion of a partly completed building showing the application of a roof cover system of the invention to unclad roof framing.

In a second preferred embodiment of the invention, a heat shrinkable film may be applied to the roof framing of an uncompleted building. In this embodiment as shown in FIG. 3, the heat shrinkable film 18 is applied after the roof framing is complete but preferably prior to the attachment of facia boards.

In this embodiment also, lengths of film are prepared from suitable width rolls sufficient to stretch from one side of the roof to an opposite side. In this case the trailing and leading edges of the length of film are preferably attached by means of battens 20 fixed to the underside of the outer ends 26 of rafters 28, that is between the outer ends of the rafters 28 and the wall frame 30.

Figure 4:
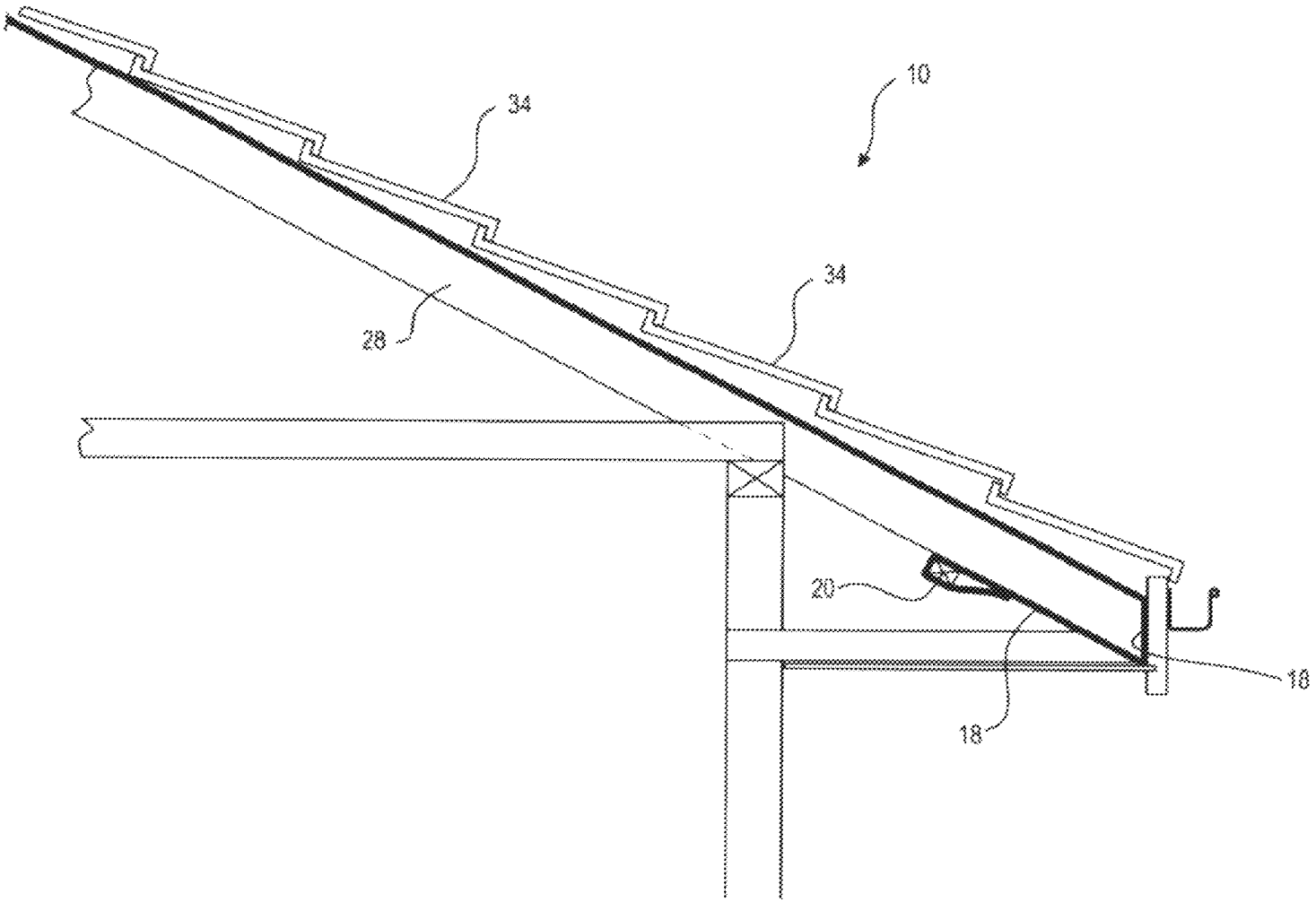
FIG. 4 is a further side sectioned view of the building of FIG. 3 showing the roof cover system of the invention functioning as a permanent sarking layer.

The heat shrinkable film 18 in this embodiment, is provided with a heat reflecting upper surface 32 so that the film 18 forms a permanent sarking layer beneath the roofing cladding, either tiles 34, as shown in FIG. 4, or metal sheeting. Thus, in this embodiment the heat shrinkable film of the invention act both to protect the timberwork of a building under construction and provides a replacement for conventional reflective sarking.

The weatherproof nature of the heat shrinkable material applied in this way provides for internal work on the building to continue in the event of inclement weather, thus increasing productivity and economy of construction.

Third Preferred Embodiment

In this further preferred embodiment, with reference now to FIGS. 5 to 10, a cover for at least a portion of a roof of a damaged building or a building under construction, may be formed of several sheets of a polymer material such as a heat shrinkable polyethylene film.

Figure 5:
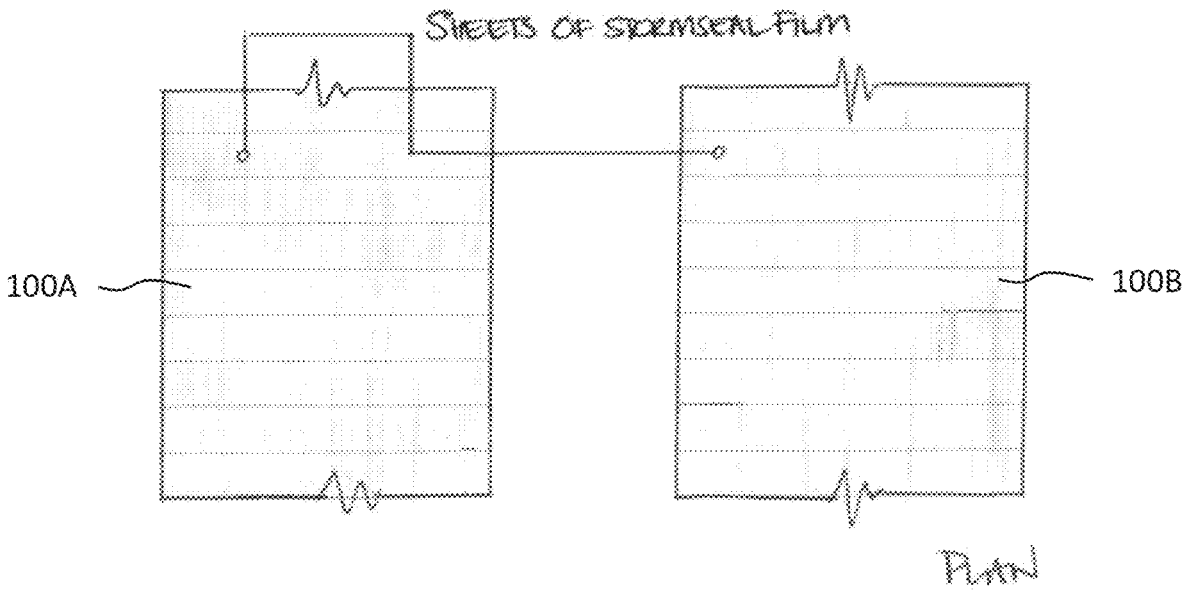
FIG. 5 shows a pair of sheets positioned side by side on a supporting surface.
Figure 6:
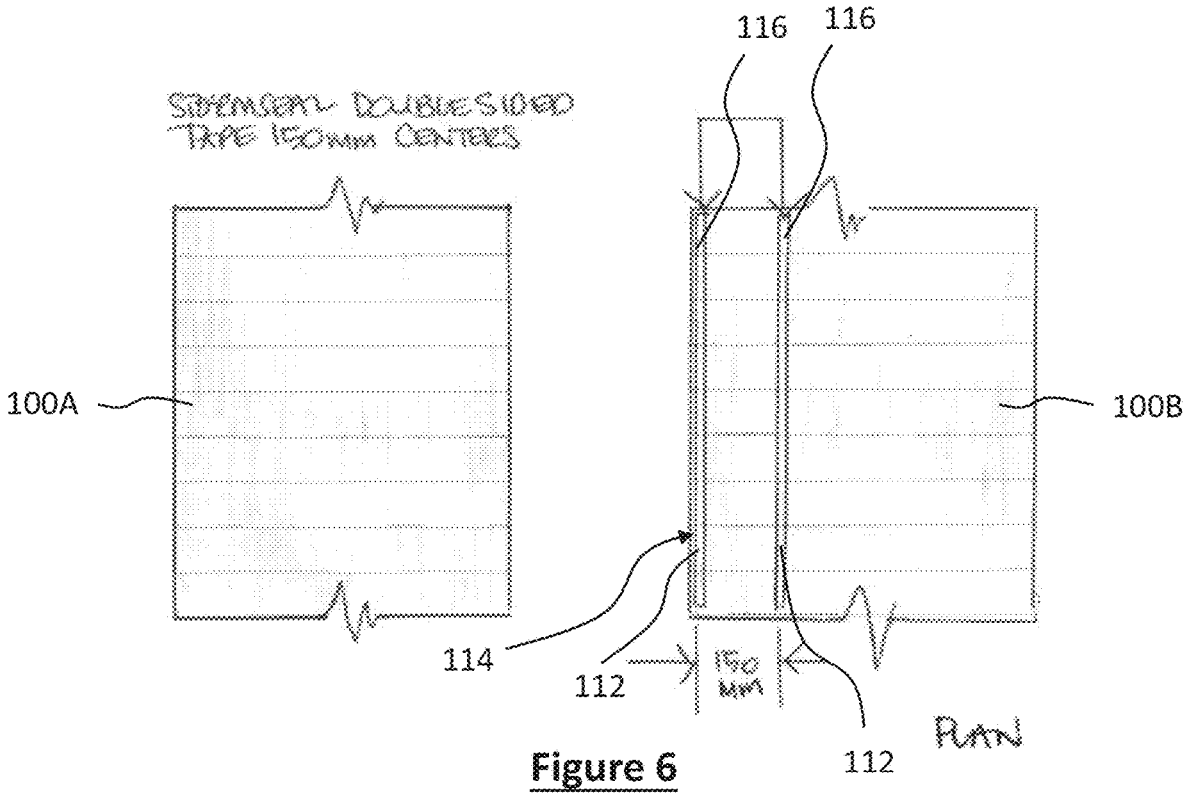
FIG. 6 shows application of strips of tape to one of the sheets of FIG. 5.

In a first step as shown in FIG. 5 a first pair of sheets 100A and 100B of required length are positioned side by side on a supporting surface. Strips 112 of double-sided adhesive tape are then applied to one of the sheets, sheet 100B in FIG. 6, with one of the strips 112 positioned adjacent the adjoining edge 114, and the second some distance, preferably 150 cm from the first.

Figure 7:
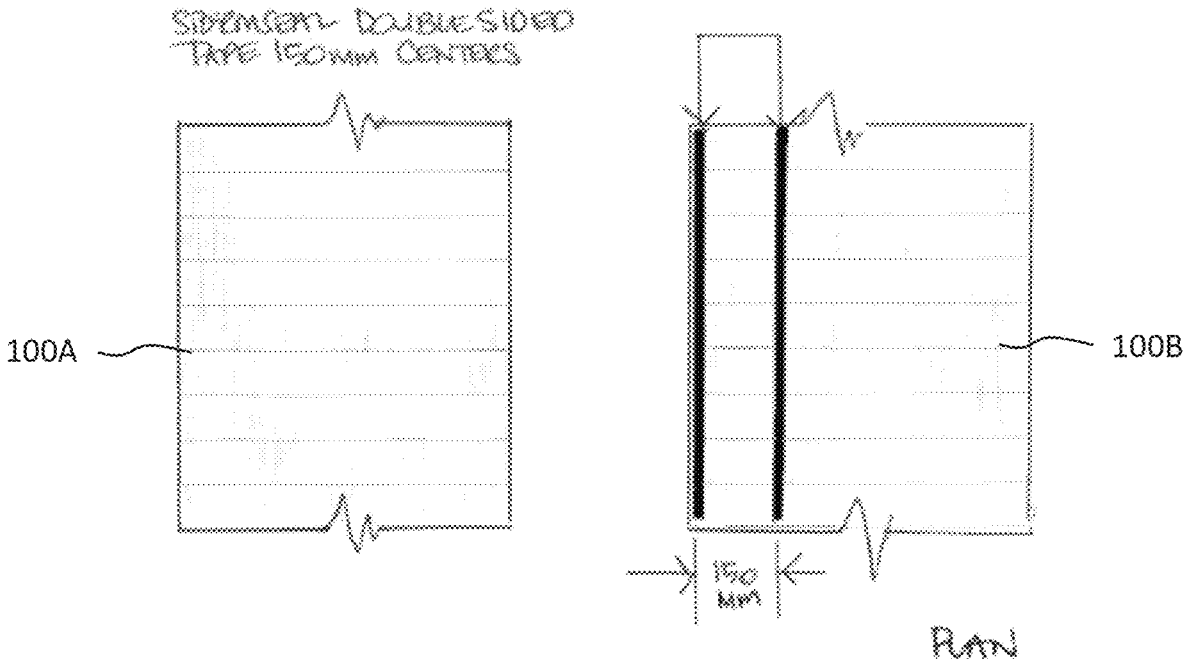
FIG. 7 shows the sheets of FIG. 6 wherein the backing material protecting the adhesive layer of the strips is removed.
Figure 8:
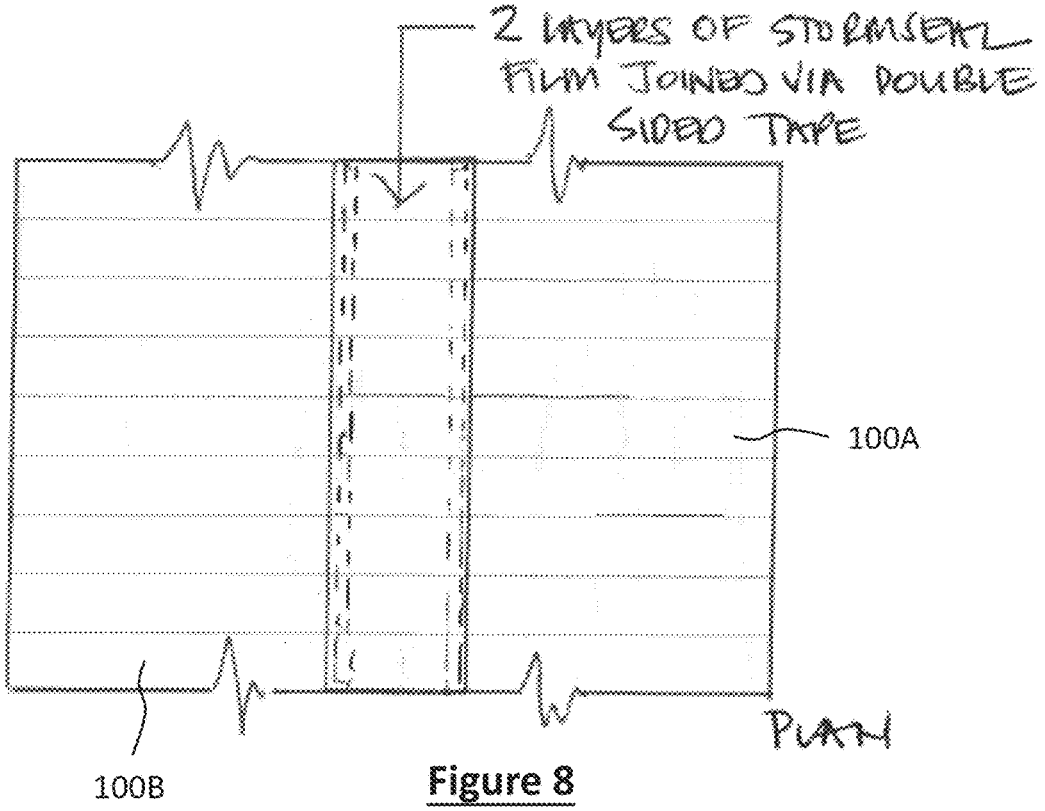
FIG. 8 shows the two sheets joined to form the joined sheets by overlapping the two sheets of FIG. 7.

The backing material 116 protecting the adhesive layer of the strips 112 is then removed exposing the adhesive as shown in FIG. 7. The second sheet 100B is then turned over and placed over the adjacent sheet 100A with the overlap according to the separation of the adhesive strips, thus in this example, by 150 cm to form the joined sheets as shown in FIG. 8.

Figure 9:
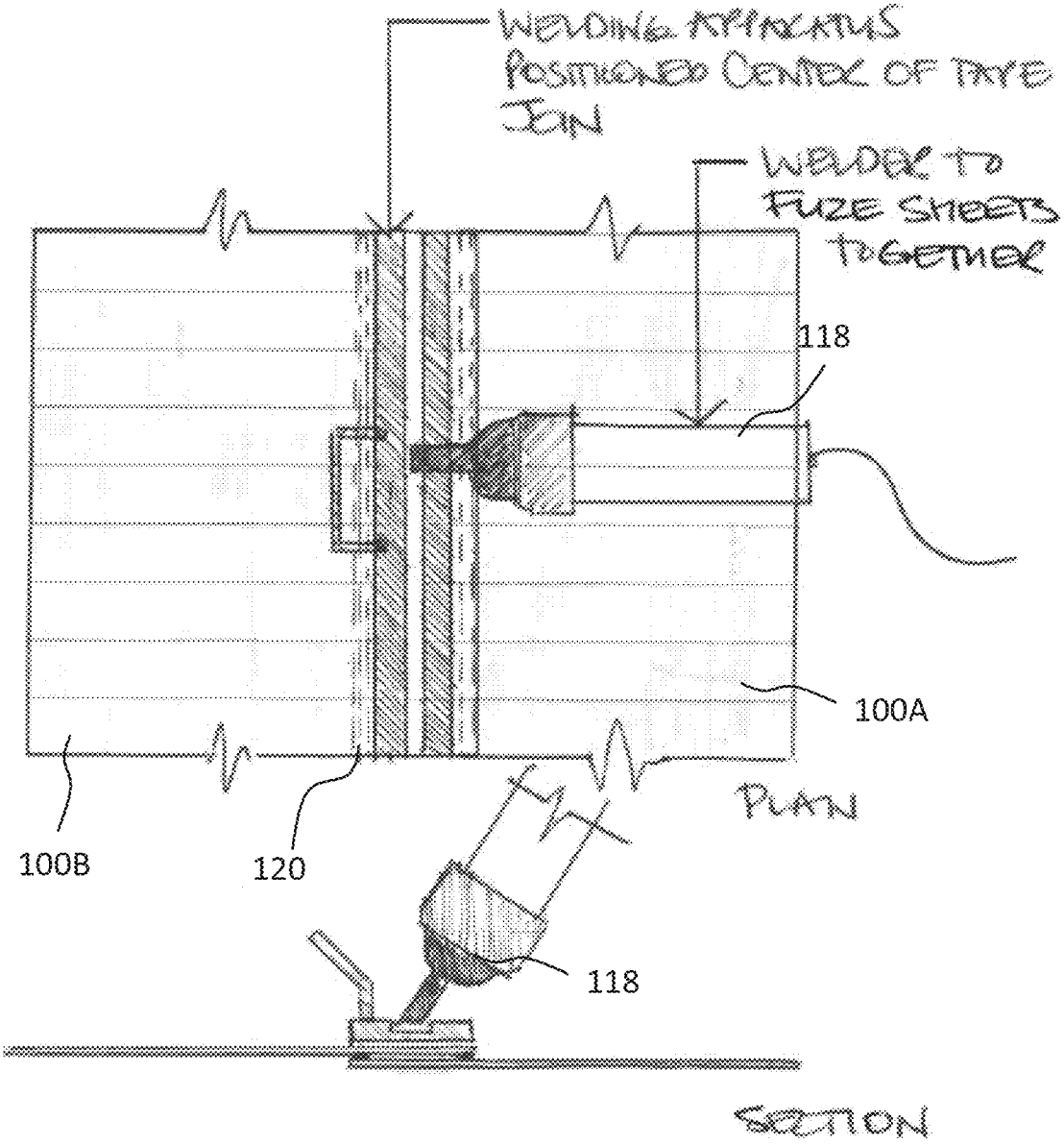
FIG. 9 shows applying heat by a suitable heat source to weld the joined sheets of FIG. 8 together.
Figure 10:
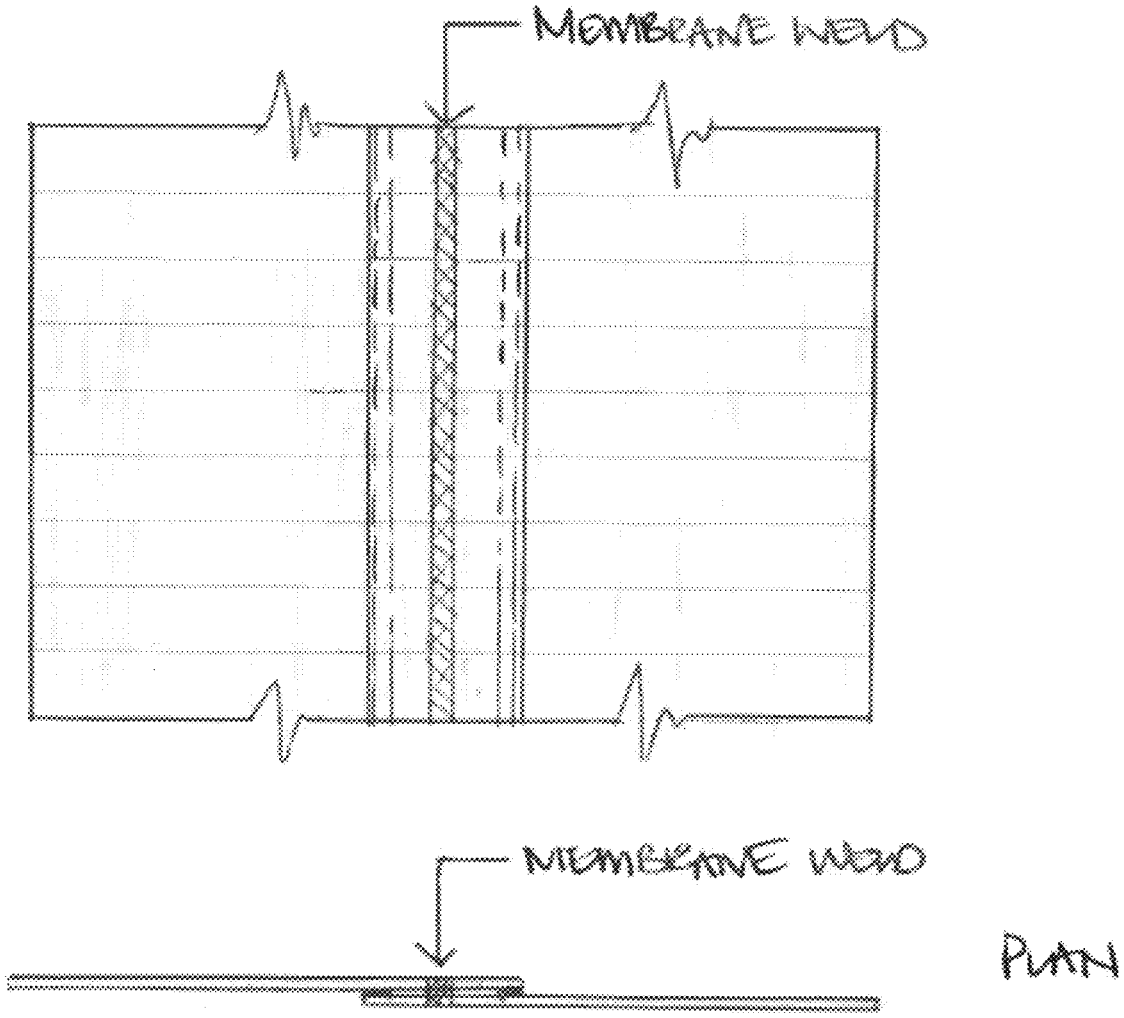
FIG. 10 shows the welded sheets of FIG. 9.

Turning now to FIG. 9, heat is applied by a suitable heat source 118 along that portion of sheet 100B lying intermediate between the double-sided strips now between the two layers of material, to weld the sheets 100A and 100B together. A guide 120 may be used to more accurately direct the applied heat. This procedure may be repeated to add further sheets until the width required to cover the area of the roof is reached.

Fourth Preferred Embodiment

Figure 11:
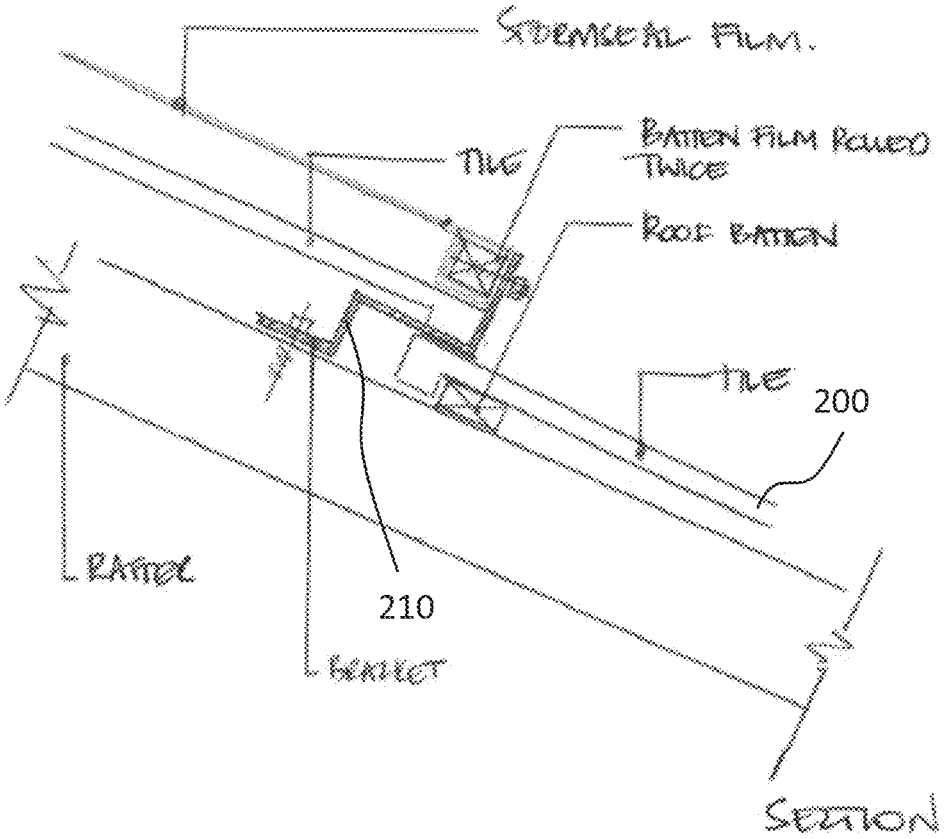
FIG. 11 is a side sectioned view of a portion of a roof showing the application of a protection film to the rood in according with a further embodiment of the invention.
Figure 12:
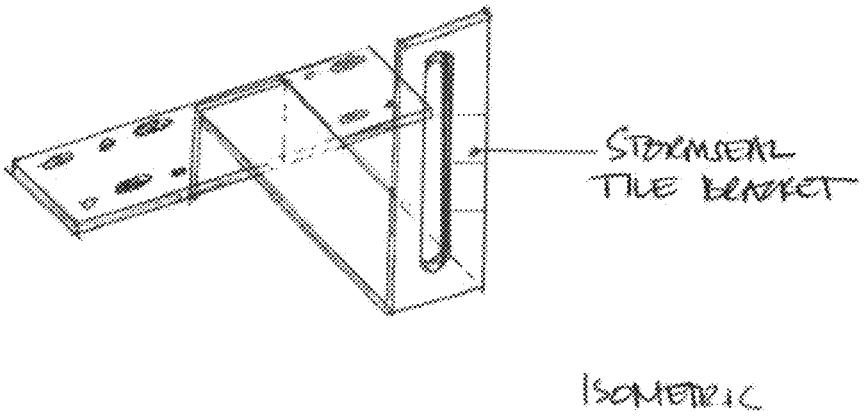
FIG. 12 shows a bracket to be applied on the roof of FIG. 11.

In this fourth preferred embodiment now with reference to FIGS. 11 and 12, the application of a protective film to a damaged roof or roof under construction where the film cannot be secured at the edge of the structure, that is, where the film cannot be wrapped over a gutter. For example, this situation may arise where safety roof railings have been installed at the roof edge to protect personnel working on the roof, or where the area to be covered is at some distance from the roof edge making it uneconomical to extend the film to the roof edge.

As shown in FIGS. 11 and 12, roof tiles 200 of a tiled roof, either adjacent to the area requiring protection, or at the roof edge, are removed to allow brackets 210 to be attached at intervals, preferably of 1800 cms, along an underlying roof framing where tiles have been removed.

The brackets 210 provided support for lengths of suitable material, for example timber battens. A portion of the trailing (or leading) end of the sheet of film 212 is wrapped around the batten (obscured in FIGS. 11 and 12 by the enveloping film) sufficient to secure the film to the batten, which may then be fastened to the supporting brackets 210.

Fifth Preferred Embodiment

Figure 13:
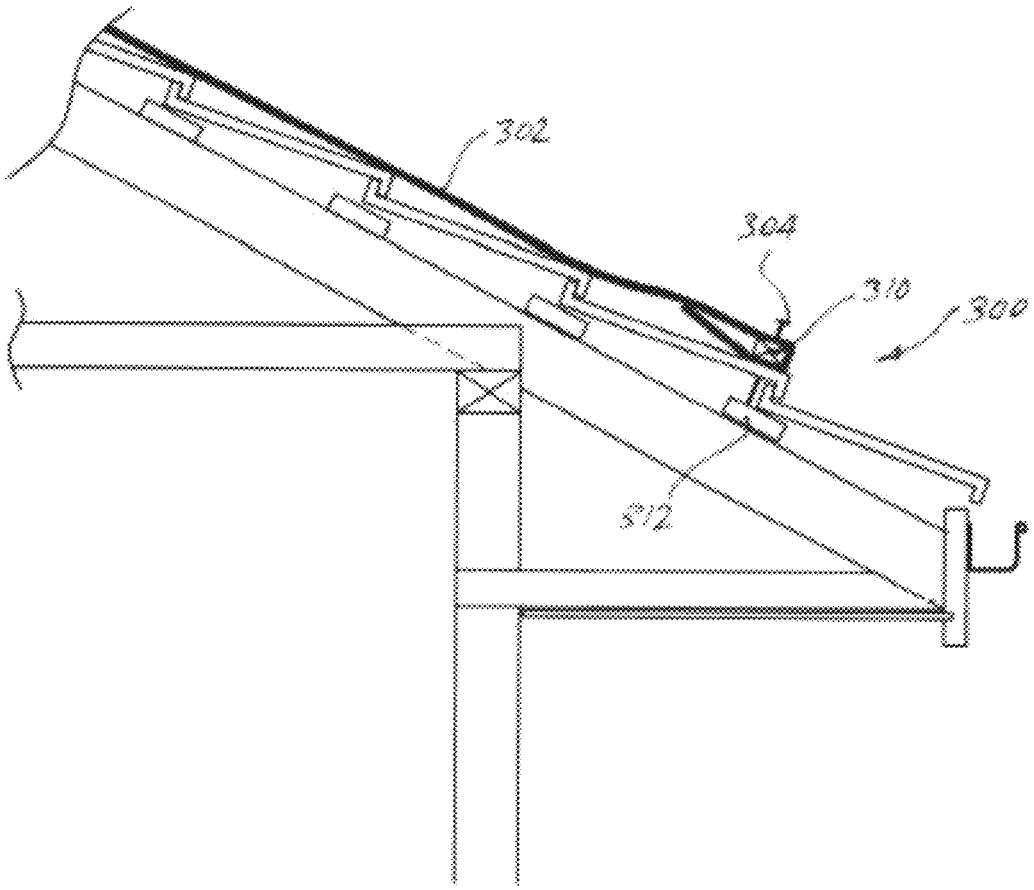
FIG. 13 is a side sectioned view of a portion of a roof showing the application of a sheet of protection film to the roof in accordance with a further embodiment of the invention.
Figure 14:
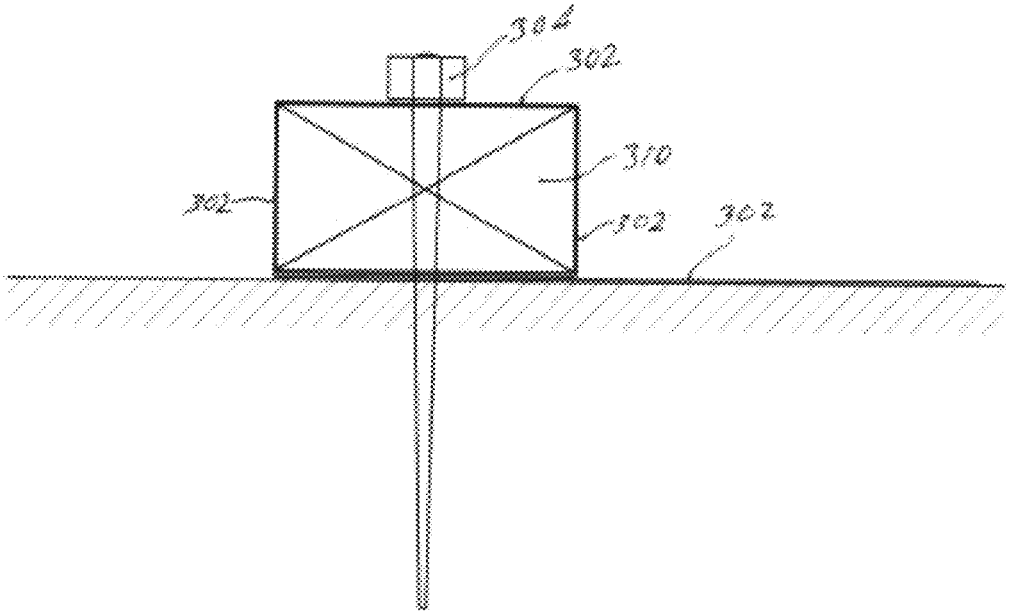
FIG. 14 is a side sectioned view of a portion of a roof showing the application of a sheet of protection film to the roof in accordance with a further embodiment of the invention.
Figure 15:
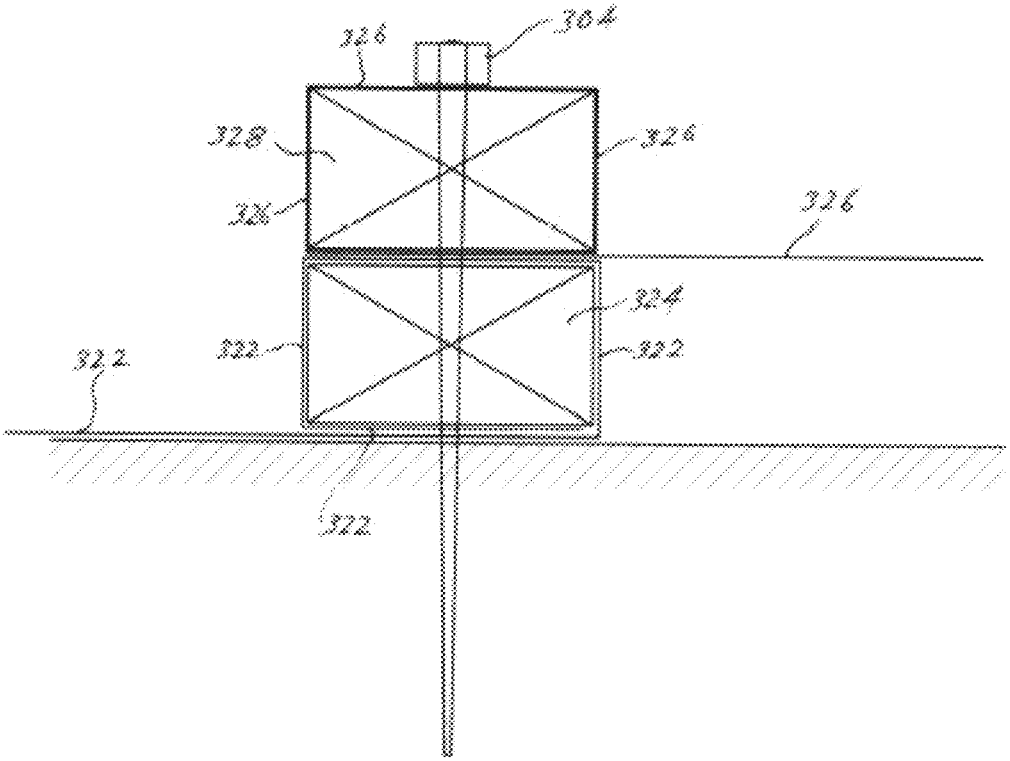
FIG. 15 is a side sectioned view of a portion of a roof showing the application of a sheet of protection film to the roof in accordance with a further embodiment of the invention.

In this further preferred embodiment, with reference now to FIGS. 13 to 15, an edge or edges 300 of a sheet of protective film 302 of polyethylene material, may again be wrapped around a length of, for example, a batten 310, located above an underlying batten 312 of the roof frame structure, and the film securing batten 310 secured to the underlying batten 312 by suitable fasteners 304.

The film 302 may be over-wrapped as in the example of FIG. 13, or under-wrapped as in FIG. 14.

Situations may arise in which the size of available film 302 is insufficient for example where a large area of roof requires protection and heat welding adjoining length of material impractical or undesirable. In that case as shown in FIG. 15 adjoining films may be joined together to form a continuous covering over the roof by wrapping a leading edge portion 320 of a first film 322 around a first batten 324, with the trailing end 325 of the adjoining film 326 is wrapped around a second batten 328. Thus prepared, the two battens 324 and 328 are placed one on top of the other, again preferably positioned over a batten of the underlying roof framing, and secured by a suitable fastener 304.

It will be understood, that although it may be necessary on a tiled roof to make use of the underlying battens of the roof framing for securing the film retaining batten by drilling through the tiles, a film securing batten may be secured directly to other roof cladding material such as, for example, metal cladding.

Sixth Preferred Embodiment

In this further embodiment, sheets of film may be prepared as described in the embodiments above, but in this instance the film of material may be affixed directly to a roof surface by use of double-sided adhesive tape. In a preferred arrangement, strips of the double-sided tape are prepared by removing the protective covering over the adhesive from one side of the tape and the strips placed on the roof surface around the area required to be covered.

The protective covering over the now uppermost sides of the strips of the positioned tape and the film pressed down onto the now exposed adhesive to secure the film in position.

Seventh Preferred Embodiment

Figure 16:
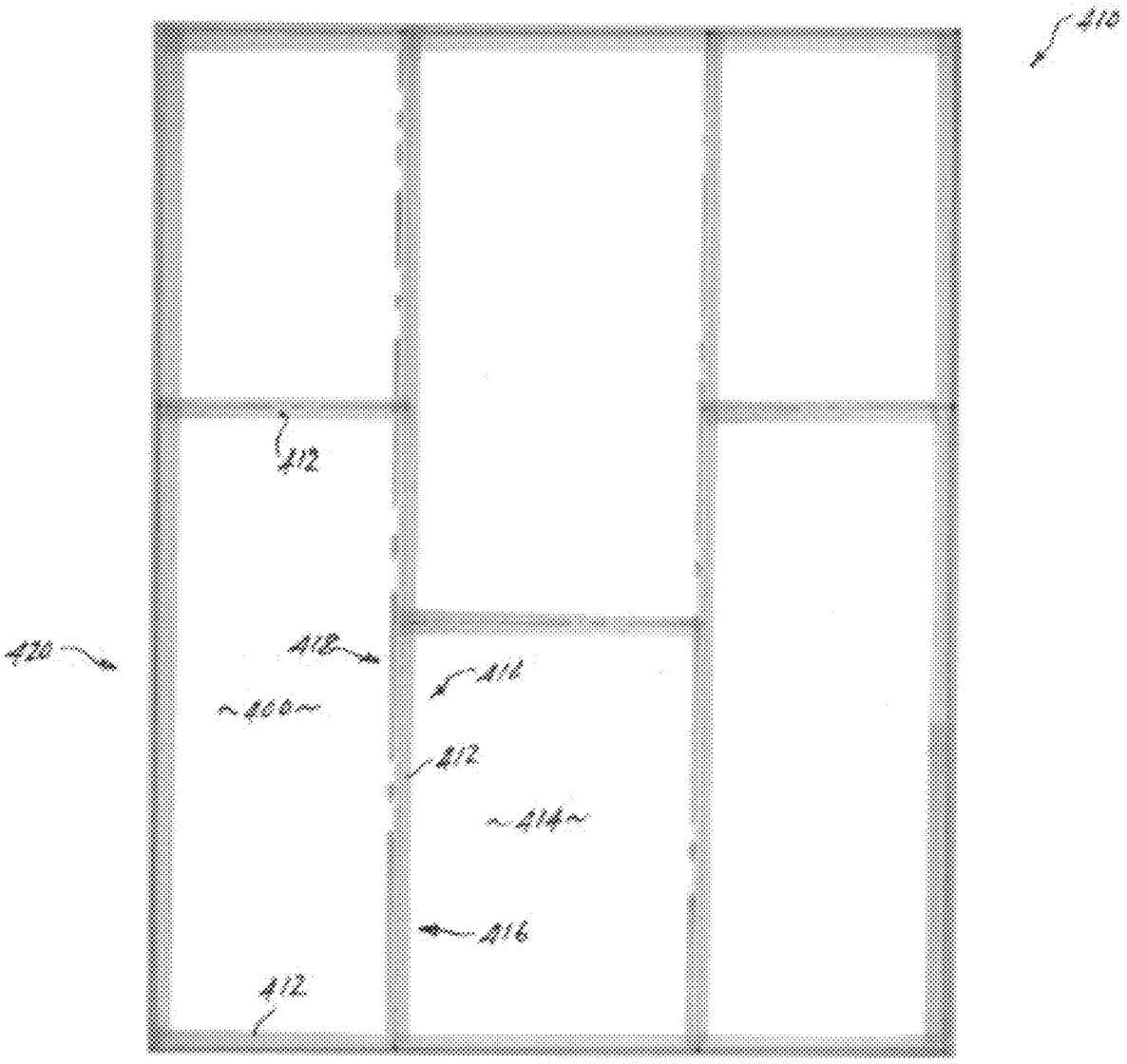
FIG. 16 is a plan view of sheets of the film being affixed to a portion of a roof surface in accordance with a further embodiment of the invention.

In still a further preferred embodiment and with reference now to FIG. 16, a damaged or leaking roof may be made waterproof by initially securing sheets of heat shrinkable film directly to the roof surface by means of a suitable adhesive.

In a preferred procedure, a first sheet 400 of the required number of sheets of heat shrinkable material is laid out on the roof surface 410 to indicate the sheet perimeter, and strips of adhesive 412 applied to at least the roof surface coincident with the sheet edges to be secured. Adhesive can also be applied to the edge or edges of the sheet to be secured.

This first sheet 400 is then brought into alignment with the prepared adhesive 412 on the roof surface 410 and a roller applied over the areas of adhesive to ensure bonding.

Adhesive is now applied to the roof surface for an adjoining second sheet 414, and the adjoining second sheet applied to the prepared adhesive with an overlap 416 over the adjacent edge 418 of the first sheet 400. Heat is then applied to the overlap 416 to heat weld the film of the sheets one to another along the overlap.

Thus, an area of a roof surface can be sequentially provided with a protective film of heat shrinkable material. After the recommended curing time of the adhesive has elapsed, heat is applied to the heat shrinkable material to shrink and closely conform the film to the roof surface.

Preferably, edges of sheets along an edge 420 of the roof, may be secured mechanically, (in addition to, or alternative to, adhesive) by any of the arrangements described above, for example by securing the sheet edge to a batten which may be attached to the edge of the roof by suitable fasteners.

In Use

Although in any of the above described embodiments, the preferred film is that of a heat shrinkable material, in at least some situations it may be unnecessary or undesirable to apply heat to the material. In those situations, the strength of the film is sufficient to confer the desired degree of protection to the roof.

The invention claimed is:

1. A method of applying an assembly of sheets of waterproof film of polymer material to a surface of a roof, the method including the steps of:

A. placing a first pair of sheets of the polymer material side by side on a supporting surface, B. preparing a first sheet of the first pair of sheets with two strips of double-sided adhesive tape; a first of the two strips positioned adjacent an adjoining edge of the first sheet with a second strip at some distance from the first, C. turning a second of the first pair of sheets over to overlap the first sheet with the overlap covering said some distance between the first and second strips of adhesive tape, D. heat welding the second sheet to the first sheet along the overlap by applying heat to a portion of the second sheet intermediate between the strips of double-sided adhesive tape, repeating the above steps A to D to cover an area of the roof surface with a number of additional sheets of the polymer material;

wherein edges of the sheets along edges of the roof surface are affixed to the edges of the roof by mechanical fastened perimeter battens.

2. The method of claim 1 wherein the polymer material is a heat shrinkable material.

3. The method of claim 1 further comprising a step of applying heat to the sheets to shrink and conform the sheets to the roof surface.

* * * * *